US010046586B2

(12) United States Patent
Shigeta

(10) Patent No.: US 10,046,586 B2
(45) Date of Patent: Aug. 14, 2018

(54) TRI-FOLD CARD AND MANUFACTURING METHOD THEREFOR

(71) Applicant: ANGEL PLAYING CARDS CO., LTD., Shiga (JP)

(72) Inventor: Yasushi Shigeta, Shiga (JP)

(73) Assignee: ANGEL PLAYING CARDS CO., LTD., Shiga (JP)

( * ) Notice: Subject to any disclaimer, the term of this patent is extended or adjusted under 35 U.S.C. 154(b) by 157 days.

(21) Appl. No.: 15/026,146

(22) PCT Filed: Sep. 29, 2014

(86) PCT No.: PCT/JP2014/004972
§ 371 (c)(1),
(2) Date: Mar. 30, 2016

(87) PCT Pub. No.: WO2015/045415
PCT Pub. Date: Apr. 2, 2015

(65) Prior Publication Data

US 2016/0243875 A1 Aug. 25, 2016

(30) Foreign Application Priority Data

Sep. 30, 2013 (JP) ..... 2013-216775

(51) Int. Cl.
*B42D 15/00* (2006.01)
*B42D 15/04* (2006.01)

(52) U.S. Cl.
CPC ..... *B42D 15/008* (2013.01); *B42D 15/042* (2013.01)

(58) Field of Classification Search
CPC ..... B42D 15/008; B42D 15/042
See application file for complete search history.

(56) References Cited

U.S. PATENT DOCUMENTS 5,845,942 A * 12/1998 Hansen ..... B42D 15/00 283/60.1
2006/0290132 A1* 12/2006 Silaprom ..... B42D 15/042 281/5
2008/0143537 A1 6/2008 Nichols
(Continued)

FOREIGN PATENT DOCUMENTS

CN 1102158 A 5/1995
CN 202200691 U 4/2012
(Continued)

OTHER PUBLICATIONS

Chinese Office Action and Search Report, Chinese Patent Application No. 201480053703.9, dated Aug. 22, 2016.

*Primary Examiner* — Gary C Hoge
(74) *Attorney, Agent, or Firm* — Norton Rose Fulbright US LLP

(57) ABSTRACT

A tri-fold card of the present invention has such a shape that the tri-fold card can be unfolded to the state in which three cards are lined up adjacent to each other, and has a tangent line or a boundary between the middle one of three cards and each of the cards at both ends of the card. The lined-up cards are bonded to a plastic film mount. The tri-fold card is folded from an unfolded state to a folded state. In folding, the tri-fold card is mountain-folded at each tangent line or each boundary. As necessary, a pattern or characters is/are printed on one or both sides of the cards.

13 Claims, 4 Drawing Sheets

(a)

(b)

(56) References Cited

U.S. PATENT DOCUMENTS

| | | | | |
|---|---|---|---|---|
| 2010/0095566 | A1* | 4/2010 | Gustafson, Jr. | B42D 15/042 40/124.01 |
| 2010/0216619 | A1* | 8/2010 | Powell | B42D 15/008 493/405 |
| 2011/0072694 | A1* | 3/2011 | Bowen | B42D 15/042 40/124.09 |
| 2012/0228859 | A1* | 9/2012 | Stobbe | G09F 23/00 283/56 |
| 2013/0260091 | A1* | 10/2013 | Stein | B42D 1/004 428/131 |
| 2014/0083603 | A1* | 3/2014 | DeLise, Jr. | B31D 1/022 156/227 |
| 2016/0019516 | A1* | 1/2016 | Jewell | G06Q 20/208 235/375 |

FOREIGN PATENT DOCUMENTS

| | | | |
|---|---|---|---|
| CN | 102717619 | A | 10/2012 |
| JP | 2002192864 | A | 7/2002 |
| JP | 3141191 | U | 2/2008 |
| JP | 2008229975 | A | 10/2008 |
| JP | 4713657 | B2 | 10/2009 |
| JP | 2009220584 | A | 10/2009 |
| WO | 9425287 | A1 | 11/1994 |
| WO | 0154921 | A2 | 8/2001 |

* cited by examiner (a)

(b)

(a)

(b)

TRI-FOLD CARD AND MANUFACTURING METHOD THEREFOR

CROSS REFERENCE TO RELATED APPLICATIONS

This application is a National Phase application under 35 U.S.C. § 371 of PCT Application PCT/JP2014/004972, filed Sep. 29, 2014, which application claims priority benefit to Japanese Application Serial No. 2013-216775, filed Sep. 30, 2013, which applications are hereby incorporated by reference.

TECHNICAL FIELD

The present invention relates to a durable tri-fold card and the method for manufacturing the tri-fold card.

BACKGROUND ART

A tri-fold card is typically employed for, e.g., a health insurance card (see, e.g., Patent Literature 1).

In a typical tri-fold card, e.g., a perforation line is formed for tri-folding at each folding line, or a piece of thick paper is used such that cutouts are formed to form mountain-folding lines.

However, folding portions of such a card are weaker than other portions. For this reason, there is a disadvantage that rupture is caused from the folding portions due to repeated use. On the other hand, when these folding portions are formed stronger, the thickness thereof increases, leading to a disadvantage that card handling is difficult.

CITATION LIST

Patent Literature

Patent Literature 1: Japanese Utility Model No. 3141191 (FIG. 1)

SUMMARY OF INVENTION

Technical Problem

The present invention has been made in view of the above-described situation. The present invention is intended to provide a tri-fold card having a reduced thickness and being durable even when the card is repeatedly folded and used and to provide the method for manufacturing the tri-fold card.

Solution to Problem

One aspect of the present invention relates to the method for manufacturing a tri-fold card. The tri-fold card manufacturing method includes the step of preparing card paper having such a size that a single card group of three cards lined up adjacent to each other is cut out, and cutting the card paper at a tangent line or a boundary between the card positioned in the middle of the card group and each of the cards positioned at both ends of the card group, a portion of the card paper remaining uncut in the vertical direction; the step of bonding the card paper to a plastic film mount larger than the outer contour of the card group; the step of cutting the card paper and the plastic film mount along the outer contour of the card group to form a tri-fold card with the unfolded card group; and the step of mountain-folding the tri-fold card at the tangent line or the boundary, as a folding line, between the middle card of the tri-fold card and each of the end cards of the tri-fold card.

Moreover, another aspect of the present invention relates to a tri-fold card. The tri-fold card includes a single card group of three cards lined up adjacent to each other. The card group has an unfoldable shape, and is cut at a tangent line or a boundary between the card positioned in the middle of the card group and each of the cards positioned at both ends of the card group. The card group is bonded to a plastic film mount, and is mountain-folded at the tangent line or the boundary as a folding line.

Further, still another aspect of the present invention relates to a tri-fold card. The method for manufacturing such a tri-fold card includes the step of preparing card paper having such a size that a plurality of lined-up card groups each formed with three cards lined up adjacent to each other are cut out, and cutting the card paper at all of tangent lines or boundaries each formed between the card positioned in the middle of a corresponding one of the card groups and each of the cards positioned at both ends of the corresponding one of the card groups, a portion of the card paper remaining uncut in the vertical direction; the step of bonding the card paper to a plastic film mount having a size including all of the card groups in the state in which the card groups are lined up; the step of cutting the card paper and the plastic film mount along the outer contour of each card group to form a plurality of tri-fold cards with the unfolded card groups; and the step of mountain-folding each tri-fold card at the tangent line or the boundary, as a folding line, between the middle card of the tri-fold card and each of the end cards of the tri-fold card.

As described below, there are other aspects of the present invention. Thus, disclosure of the present invention provides some aspects of the present invention, and is not intended to limit the scope of the claimed invention described herein.

BRIEF DESCRIPTION OF DRAWINGS

FIG. 1(*b*) is a side view of the unfolded tri-fold card of the first and second embodiments of the present invention.

DESCRIPTION OF EMBODIMENTS

The present invention will be described below in detail. Note that the detailed description made below and the attached drawings do not limit the present invention.

A tri-fold card manufacturing method of the present invention includes the step of preparing card paper having such a size that a single card group of three cards lined up adjacent to each other is cut out, and cutting the card paper at a tangent line or a boundary between the card positioned in the middle of the card group and each of the cards positioned at both ends of the card group, a portion of the card paper remaining uncut in the vertical direction; the step of bonding the card paper to a plastic film mount larger than the outer contour of the card group; the step of cutting the card paper and the plastic film mount along the outer contour of the card group to form a tri-fold card with the unfolded card group; and the step of mountain-folding the tri-fold card at the tangent line or the boundary, as a folding line, between the middle card of the tri-fold card and each of the end cards of the tri-fold card.

Moreover, the tri-fold card of the present invention includes a single card group of three cards lined up adjacent to each other. The card group has an unfoldable shape, and is cut at a tangent line or a boundary between the card positioned in the middle of the card group and each of the cards positioned at both ends of the card group. The card group is bonded to a plastic film mount, and is mountain-folded at the tangent line or the boundary as a folding line.

Further, the tri-fold card manufacturing method of the present invention includes the step of preparing card paper having such a size that a plurality of lined-up card groups each formed with three cards lined up adjacent to each other are cut out, and cutting the card paper at all of tangent lines or boundaries each formed between the card positioned in the middle of a corresponding one of the card groups and each of the cards positioned at both ends of the corresponding one of the card groups, a portion of the card paper remaining uncut in the vertical direction; the step of bonding the card paper to a plastic film mount having a size including all of the card groups in the state in which the card groups are lined up; the step of cutting the card paper and the plastic film mount along the outer contour of each card group to form a plurality of tri-fold cards with the unfolded card groups; and the step of mountain-folding each tri-fold card at the tangent line or the boundary, as a folding line, between the middle card of the tri-fold card and each of the end cards of the tri-fold card.

According to the tri-fold card of the present invention and the tri-fold card manufacturing method of the present invention, a tri-fold card having a reduced thickness and being durable even when the card is repeatedly folded and used can be provided.

First Embodiment

Figure 1:
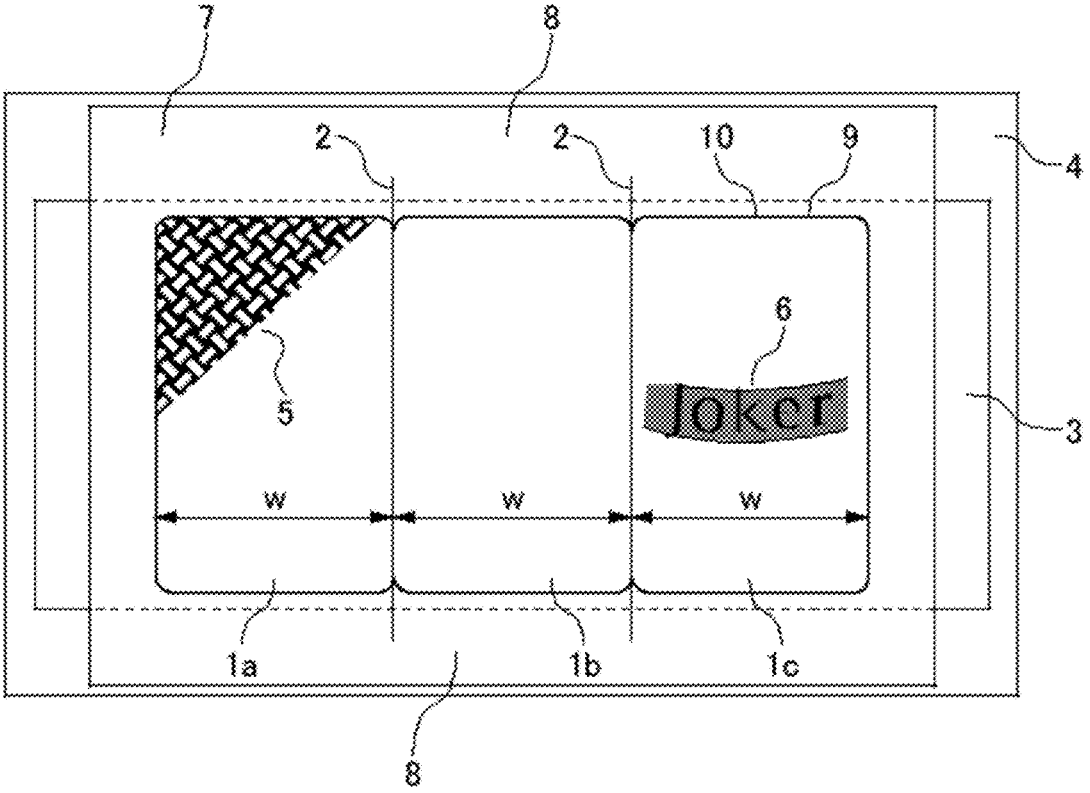
FIG. 1(*a*) is a plan view of a tri-fold card of a first embodiment of the present invention, and for the sake of description of each step of a tri-fold card manufacturing method, illustrates card paper, a plastic film mount, and a hologram film.
Figure 1:
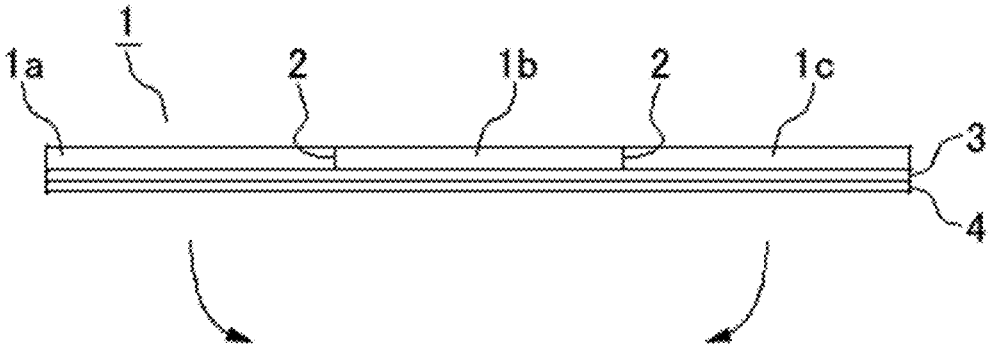
Figure 2:
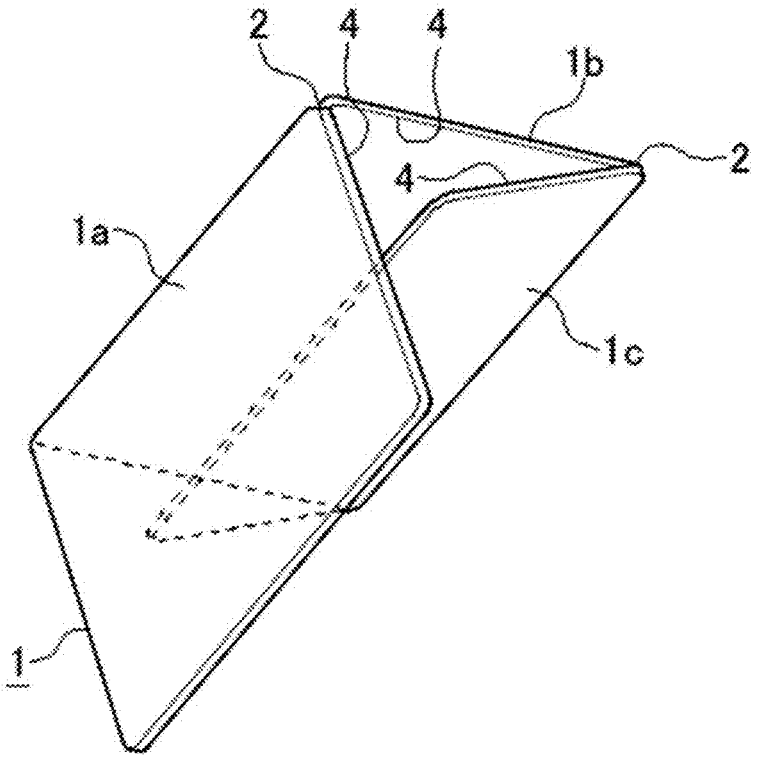
FIG. 2(*a*) is a perspective view of the folded tri-fold card of the first and second embodiments of the present invention, and FIG. 2(*b*) is an enlarged side view of a main portion of a folding line of the card.
Figure 2:
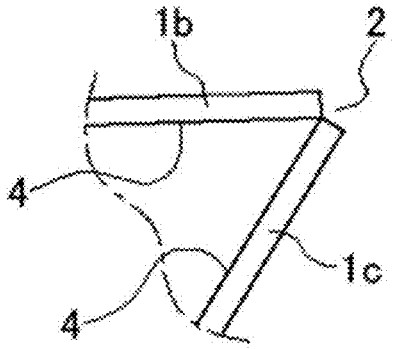

A tri-fold card and the method for manufacturing the tri-fold card will be described below in detail with reference to a first embodiment of the present invention. FIG. 1(*a*) is a plan view of the tri-fold card of the first embodiment of the present invention, and for the sake of description of each step of the tri-fold card manufacturing method, illustrates card paper, a plastic film mount, and a hologram film. FIG. 1(*b*) is a side view of the unfolded tri-fold card. FIG. 2(*a*) is a perspective view of the folded tri-fold card, and FIG. 2(*b*) is an enlarged side view of a main portion of a folding line of the card.

The tri-fold card of the first embodiment has such a shape that the tri-fold card can be unfolded to the state in which three cards 1*a*, 1*b*, 1*c* are lined up adjacent to each other. The tri-fold card of the present embodiment is configured to have a tangent line or a boundary 2 between the middle one 1*b* of three cards 1*a*, 1*b*, 1*c* and each of the cards 1*a*, 1*c* at both ends of the card 1*b*. In the state in which three cards 1*a*, 1*b*, 1*c* are lined up, these cards 1*a*, 1*b*, 1*c* are bonded to a plastic film mount 4 with a hologram film 3 being interposed therebetween. A well-known transparent or lightly-colored transparent plastic film mount, such as polypropylene, is used as the plastic film mount 4. Note that the hologram film 3 is provided for the purpose of a reflection change on the surfaces of the cards 1*a*, 1*b*, 1*c*, but may be omitted. A tri-fold card 1 is folded from an unfolded state (see FIG. 1(*b*)) to a tri-fold state (see FIG. 2(*a*)). In folding, the tri-fold card 1 is mountain-folded at each tangent line or each boundary 2 (an enlarged view is illustrated in FIG. 2(*b*)). The widths w of three cards 1*a*, 1*b*, 1*c* may be optionally adjusted such that the right and left sides of the card 1*a* are coincident with the right and left sides of the card 1*b* with the influence of the thickness of the card 1*c* being suppressed as much as possible in folding of the card 1*a* as illustrated in FIG. 2(*a*). For example, the width w of the card 1*c* may be shorter than those of the cards 1*a*, 1*b*. If the plastic film mount 4 has flexibility, folding is facilitated. As necessary, a pattern 5 or characters 6 is/are printed on one or both sides of the cards 1*a*, 1*b*, 1*c*.

Next, the tri-fold card manufacturing method of the first embodiment will be described. First, card paper 7 is prepared, which has such a size that a single card group 10 of three cards 1*a*, 1*b*, 1*c* lined up adjacent to each other can be cut out. The card paper 7 is cut at each tangent line or each boundary 2 between the card 1*b* positioned in the middle of the card group 10 and each of the cards 1*a*, 1*c* positioned at both ends of the card group 10, a portion 8 of the card paper 7 remaining uncut in the vertical direction. Then, the card paper 7 is bonded to a plastic film mount 4 larger than the outer contour 9 of the card group 10. Note that before the step of bonding the card paper 7 to the plastic film mount 4, the step of bonding a hologram film 3 to one or both sides of the card paper 7 may be further performed. A hologram film on which a pattern or a character(s) are further printed may be used as the hologram film 3.

Subsequently, the card paper 7 and the plastic film mount 4 (together with the hologram film 3 in the case of interposing the hologram film 3) are cut along the outer contour 9 of the card group 10. As a result, a tri-fold card 1 is formed with the unfolded card group 10. Although the tri-fold card 1 is divided at the cut portions along the tangent lines or the boundaries 2, these divided portions are bonded to the plastic film mount 4, and therefore, are integrated together. Subsequently, the middle card 1*b* of the tri-fold card 1 and the end cards 1*a*, 1*c* of the tri-fold card 1 are mountain-folded at the tangent lines or the boundaries 2 as folding lines. The widths w of three cards 1*a*, 1*b*, 1*c* may be optionally adjusted such that the right and left sides of the card 1*a* are coincident with the right and left sides of the card 1*b* with the influence of the thickness of the card 1*c* being suppressed as much as possible in folding of the card 1*a* as illustrated in FIG. 2(*a*). For example, the width w of the card 1*c* may be shorter than those of the cards 1*a*, 1*b*. If the plastic film mount 4 has flexibility, folding is facilitated. As described above, the tri-fold card 1 is formed.

Second Embodiment

Figure 3:
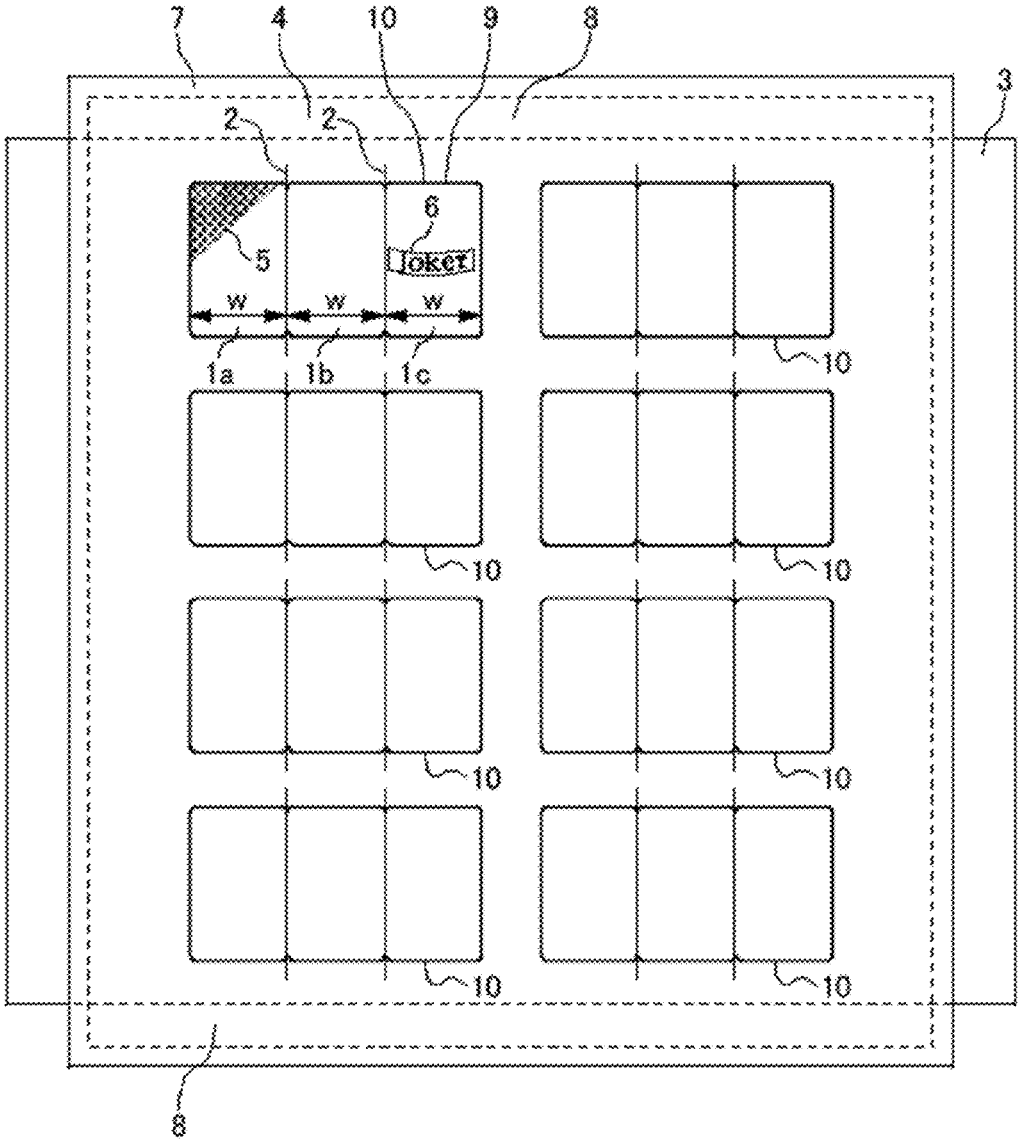
FIG. 3 is a plan view of the tri-fold card of the second embodiment of the present invention, and for the sake of description of each step of the tri-fold card manufacturing method, illustrates card paper, a plastic film mount, and a hologram film.
Figure 4:
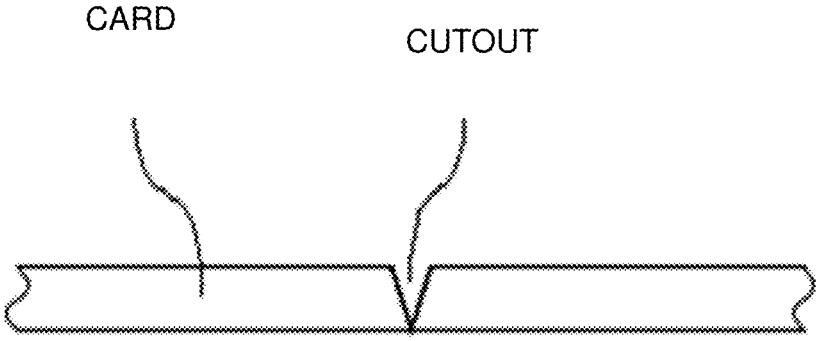
FIG. 4 is an enlarged side view of a main portion of a folding line of a typical tri-fold card.

A tri-fold card and the method for manufacturing the tri-fold card according to a second embodiment of the present invention will be described below in detail. FIG. 3 is a plan view of the tri-fold card of the second embodiment of the present invention, and for the sake of description of each step of the tri-fold card manufacturing method, illustrates card paper, a plastic film mount, and a hologram film. FIG. 1(*b*) is the side view of the unfolded tri-fold card. FIG.

2(*a*) is the perspective view of the folded tri-fold card, and FIG. 2(*b*) is the enlarged side view of the main portion of the folding line of the card.

The tri-fold card of the second embodiment has such a shape that the tri-fold card can be unfolded to the state in which three cards 1*a*, 1*b*, 1*c* are lined up adjacent to each other. The tri-fold card of the present embodiment is configured to have a tangent line or a boundary 2 between the middle one 1*b* of three cards 1*a*, 1*b*, 1*c* and each of the cards 1*a*, 1*c* at both ends of the card 1*b*. In the state in which three cards 1*a*, 1*b*, 1*c* are lined up, these cards 1*a*, 1*b*, 1*c* are bonded to a plastic film mount 4 with a hologram film 3 being interposed therebetween. A well-known transparent or lightly-colored transparent plastic film mount, such as polypropylene, is used as the plastic film mount 4. Note that the hologram film 3 is provided for the purpose of a reflection change on the surfaces of the cards 1*a*, 1*b*, 1*c*, but may be omitted. A tri-fold card 1 is folded from an unfolded state (see FIG. 1(*b*)) to a tri-fold state (see FIG. 2(*a*)). In folding, the tri-fold card 1 is mountain-folded at each tangent line or each boundary 2 (an enlarged view is illustrated in FIG. 2(*b*)). The widths w of three cards 1*a*, 1*b*, 1*c* may be optionally adjusted such that the right and left sides of the card 1*a* are coincident with the right and left sides of the card 1*b* with the influence of the thickness of the card 1*c* being suppressed as much as possible in folding of the card 1*a* as illustrated in FIG. 2(*a*). For example, the width w of the card 1*c* may be shorter than those of the cards 1*a*, 1*b*. If the plastic film mount 4 has flexibility, folding is facilitated. As necessary, a pattern 5 or characters 6 is/are printed on one or both sides of the cards 1*a*, 1*b*, 1*c*.

Next, the tri-fold card manufacturing method of the second embodiment will be described. First, card paper 7 is prepared, which has such a size that a plurality of lined-up card groups each formed with three cards 1*a*, 1*b*, 1*c* lined up adjacent to each other can be cut out. The card paper 7 is cut at all of the tangent line or the boundaries 2 each formed between the card 1*b* positioned in the middle of the card group and each of the cards 1*a*, 1*c* positioned at both ends of the card group, a portion 8 of the card paper 7 remaining uncut in the vertical direction. Then, in the state in which the card groups 10 are lined up, the card paper 7 is bonded to a plastic film mount 4 having a size including all of the card groups 10.

In this manner, the productivity of the tri-fold cards is improved.

Note that when the card paper 7 is cut at all of the tangent lines or the boundaries 2, such cutting may be performed simultaneously. Before the step of bonding the card paper 7 to the plastic film mount 4, the step of bonding a hologram film 3 to one or both sides of the card paper 7 may be further performed. A hologram film on which a pattern or a character(s) are further printed may be used as the hologram film 3.

Subsequently, the card paper 7 and the plastic film mount 4 (together with the hologram film 3 in the case of interposing the hologram film 3) are cut along the outer contour 9 of each card group 10. As a result, a plurality of tri-fold cards 1 are formed with the unfolded card groups 10. Although each tri-fold card 1 is divided at the cut portions along the tangent lines or the boundaries 2, these divided portions are bonded to the plastic film mount 4, and therefore, are integrated together. Subsequently, the middle card 1*b* and the end cards 1*a*, 1*c* are mountain-folded on each other at the tangent lines or the boundaries 2 as folding lines. The widths w of three cards 1*a*, 1*b*, 1*c* may be optionally adjusted such that the right and left sides of the card 1*a* are coincident with the right and left sides of the card 1*b* with the influence of the thickness of the card 1*c* being suppressed as much as possible in folding of the card 1*a* as illustrated in FIG. 2(*a*). For example, the width w of the card 1*c* may be shorter than those of the cards 1*a*, 1*b*. If the plastic film mount 4 has flexibility, folding is facilitated. As described above, the tri-fold cards 1 are formed.

The tri-fold card 1 formed as described above can be folded at the tangent lines or the boundaries 2. In addition, the tri-fold card 1 is bonded to the plastic film mount 4, and therefore, the tri-fold card 1 can be bent without separation. Moreover, no perforation line or cutout along each folding line is required, and therefore, a relatively-high strength can be exhibited even when bending is repeated.

The embodiments of the present invention have been described above. However, modification can be, needless to say, made to the above-described embodiments by those skilled in the art within the scope of the present invention.

The suitable embodiments of the present invention conceivable at the present moment have been described above. However, it is understood that various modifications can be made to the embodiments of the present invention, and the claims attached hereto include all of the modifications within the true spirit and scope of the present invention.

INDUSTRIAL APPLICABILITY

As described above, the tri-fold card manufacturing method of the present invention is useful because such a method exhibits an advantageous effect of providing a tri-fold card having a reduced thickness and being durable even when the card is repeatedly folded and used.

REFERENCE SIGNS LIST

1 tri-fold card
1*a*, 1*b*, 1*c* card
2 tangent line or boundary
3 hologram film
4 plastic film mount
10 card group

The invention claimed is:

1. A method for manufacturing a tri-fold card, comprising:

a step of preparing card paper having such a size that a single card group of three cards lined up adjacent to each other is cut out, and cutting the card paper at a tangent line or a boundary between the card positioned in a middle of the card group and each of the cards positioned at both ends of the card group, a portion of the card paper remaining uncut in a vertical direction;

a step of bonding the card paper to a plastic film mount larger than an outer contour of the card group;

a step of cutting the card paper and the plastic film mount along the outer contour of the card group to form a tri-fold card with the unfolded card group; and a step of mountain-folding the tri-fold card at the tangent line or the boundary, as a folding line, between the middle card of the tri-fold card and each of the end cards of the tri-fold card, with the tangent line or the boundary being a ridge.

2. The method for manufacturing a tri-fold card of claim 1, wherein a pattern or a character is printed on one or both sides of the card paper.

3. The method for manufacturing a tri-fold card of claim 1, wherein the plastic film mount is transparent.

4. The method for manufacturing a tri-fold card of claim 1, further comprising:

a step of bonding a hologram film to one or both sides of the card paper.

5. The method for manufacturing a tri-fold card of claim 4, further comprising:

a step of printing a pattern or a character on the hologram film.

6. A tri-fold card manufactured by the method for manufacturing a tri-fold card of claim 1.

7. A method for manufacturing a tri-fold card, comprising:

a step of preparing card paper having such a size that a plurality of lined-up card groups each formed with three cards lined up adjacent to each other are cut out, and cutting the card paper at all of tangent lines or boundaries each formed between the card positioned in a middle of a corresponding one of the card groups and each of the cards positioned at both ends of the corresponding one of the card groups, a portion of the card paper remaining uncut in a vertical direction;

a step of bonding the card paper to a plastic film mount having a size including all of the card groups in a state in which the card groups are lined up;

a step of cutting the card paper and the plastic film mount along an outer contour of each card group to form a plurality of tri-fold cards with the unfolded card groups; and a step of mountain-folding each tri-fold card at the tangent line or the boundary, as a folding line, between the middle card of the each tri-fold card and each of the end cards of the each tri-fold card, with the tangent line or the boundary being a ridge.

8. The method for manufacturing a tri-fold card of claim 7, further comprising:

a step of simultaneously cutting the card paper at all of the tangent lines or the boundaries each formed between the card positioned in the middle of a corresponding one of the card groups and each of the cards positioned at both ends of the corresponding one of the card groups.

9. The method for manufacturing a tri-fold card of claim 7, wherein a pattern or a character is printed on one or both sides of the card paper.

10. The method for manufacturing a tri-fold card of claim 7, wherein the plastic film mount is transparent.

11. The method for manufacturing a tri-fold card of claim 7, further comprising:

a step of bonding a hologram film to one or both sides of the card paper.

12. The method for manufacturing a tri-fold card of claim 11, further comprising:

a step of printing a pattern or a character on the hologram film.

13. A tri-fold card manufactured by the method for manufacturing a tri-fold card of claim 7.

* * * * *